US005961210A

United States Patent [19]

McCardel et al.

[11] Patent Number: 5,961,210

[45] Date of Patent: Oct. 5, 1999

[54] BONE CEMENT PREPARATION DEVICE, AND METHODS OF CONSTRUCTING AND UTILIZING SAME

[76] Inventors: Brian R. McCardel, 3631 Beechtree La., Okemos, Mich. 48864; Jeremiah Squires, 303 N. Marshall, Marshall, Mich. 49068

[21] Appl. No.: 08/787,276

[22] Filed: Jan. 24, 1997

[51] Int. Cl.[6] ..... B65D 81/20

[52] U.S. Cl. ..... 366/130; 604/416; 366/3

[58] Field of Search ..... 366/1, 2, 6, 3, 366/10, 139, 130, 150.1, 602; 206/219, 221; 383/66, 49, 202, 200, 59; 604/56, 82, 86, 87, 88, 201, 200, 204, 416, 408

[56] References Cited

U.S. PATENT DOCUMENTS

| | | | |
|---|---|---|---|
| 2,598,595 | 5/1952 | Peters | 206/219 |
| 3,554,256 | 1/1971 | Anderson | 604/416 |
| 3,647,386 | 3/1972 | Gilford | 206/221 |
| 4,015,945 | 4/1977 | Frankel et al. | 366/139 |
| 4,072,233 | 2/1978 | Kramer et al. | 383/202 |
| 4,470,703 | 9/1984 | Nickerson, Jr. | 366/3 |
| 4,696,404 | 9/1987 | Corella | 383/200 |
| 5,052,554 | 10/1991 | Leonard | 206/219 |
| 5,102,408 | 4/1992 | Hamacher | 604/416 |
| 5,108,387 | 4/1992 | Falk et al. | 604/408 |
| 5,207,320 | 5/1993 | Allen | 604/416 |
| 5,425,583 | 6/1995 | Wild | 383/202 |
| 5,549,380 | 8/1996 | Lidgren et al. | 366/139 |
| 5,709,467 | 1/1998 | Galliano, II | 366/130 |

FOREIGN PATENT DOCUMENTS

| | | | |
|---|---|---|---|
| 2801706 | 7/1979 | Germany | 604/416 |
| WO84/038030 | 10/1984 | WIPO | 366/139 |

*Primary Examiner*—Tony G. Soohoo

*Attorney, Agent, or Firm*—Carrier, Blackman & Associates, P.C.; William D. Blackman; Joseph P. Carrier

[57] ABSTRACT

A disposable container for preparing bone cement, comprising a flexible bag member, the bag member being substantially sealed; a port member for transferring a substantially liquid composition into the flexible bag member; and wherein the bag member includes a resilient membrane covering the port member.

20 Claims, 1 Drawing Sheet

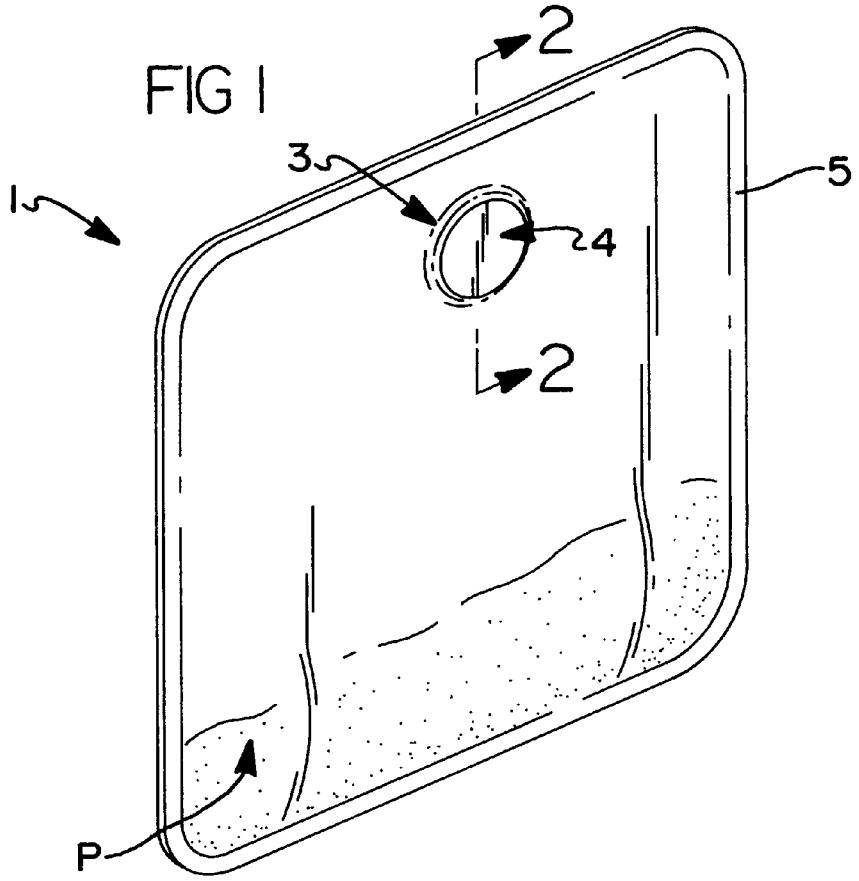
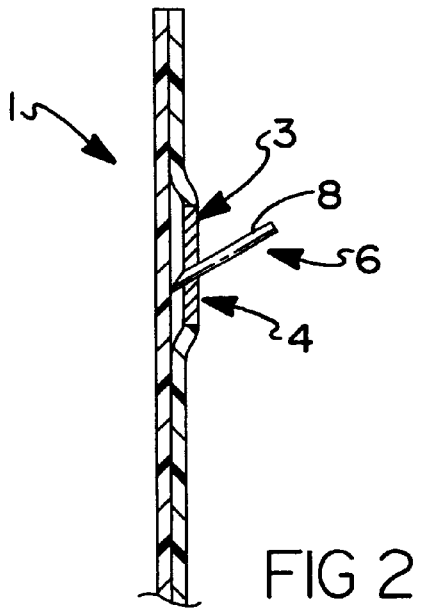
FIG 2

BONE CEMENT PREPARATION DEVICE, AND METHODS OF CONSTRUCTING AND UTILIZING SAME

BACKGROUND OF THE INVENTION

1. Field of the Invention

The present invention relates to a device for preparing bone cement, and particularly to a container in which liquid monomer and powder polymer bone cement components may be mixed in a substantial vacuum.

In surgical applications in which natural joints are replaced by prosthetic devices, bone cement is commonly used to secure the prosthetic device to the bone of the patient. Bone cement is typically comprised of a powder polymer and a liquid monomer which polymerizes about the powder polymer. The preparation of bone cement comprises the step of mixing the liquid monomer with the powder polymer in a suitable container until a homogenous cement composition is formed.

Because the mixing of the liquid monomer with the powder polymer often generates obnoxious fumes and because preparing the bone cement in an open environment has been seen to result in the cured bone cement having a degree of porosity, devices have been created which allow the powder polymer and the liquid monomer to be mixed in a substantial vacuum. These devices are typically complex structures which result in increased medical costs because, in many instances, the devices must be thrown away after a single use. As a result, an inexpensive, disposable device is needed to prepare bone cement for surgical applications.

2. The Relevant Art

Devices exist for mixing bone cement for prosthetic applications. For instance, Smith U.S. Pat. No. 5,398,483 and Magnusson U.S. Pat. No. 5,370,221 disclose bone cement containers having dual, side-by-side compartments for separately maintaining the liquid monomer and powder polymer bone cement components, and a removable seal which separates the two compartments.

Tepic U.S. Pat. No. 5,051,482 discloses an apparatus for preparing bone cement, comprising a syringe and ampoule assembly for mixing the cement ingredients.

Wild U.S. Pat. No. 5,433,526 discloses a flexible, disposable bag for holding a liquid and/or pasty composition and having an opening for dispensing the stored composition.

Koyanagi U.S. Pat. No. 5,388,910 discloses a flexible bag having a valve which allows egress of air while preventing any ingress of air into the bag.

Herrington U.S. Pat. No. 4,532,652 discloses a flexible plastic bag having a one-way valve for discharging air therefrom.

Yasumura U.S. Pat. No. 4,917,684 discloses a flexible plastic bag having at least one coverable port.

The above-cited references, however, fail to disclose or otherwise suggest a disposable and inexpensive container for mixing bone cement ingredients.

SUMMARY OF THE INVENTION

The present invention overcomes the above-discussed shortcomings of prior devices and satisfies a need for easily mixing bone cement ingredients together.

According to the invention, there is provided a flexible bag member constructed from a plastic composition; a port member which is disposed along a surface of the bag member and extends outwardly therefrom; and wherein the port member includes a membrane which covers the port member so as to maintain the contents of the bag member within the bag, yet is penetratable by a needle-like object for inserting material into the bag member.

A method of preparing bone cement according to the present invention comprises the steps of obtaining the bag member with the powder polymer material sealed therein; obtaining an instrument, such as a syringe; adding the liquid monomer to the syringe; injecting the liquid monomer into the bag member from the syringe by piercing the port member membrane with the needle syringe and discharging the liquid monomer from the syringe; and thereafter thoroughly mixing the liquid monomer and the powder polymer by hand manipulation, until a homogenous bone cement composition is formed.

It is an object of the present invention to provide a bone cement preparation device which allows for the preparing of bone cement in a substantial vacuum.

Another object of the present invention is to provide a disposable device which is simple in design and inexpensive to manufacture.

It is another object of the present invention to provide such a device which is adapted for use with conventional medical instruments in affordably preparing bone cement.

Other objects, advantages and salient features of the present invention will become apparent from the following detailed description, which, when taken in conjunction with the annexed drawings, discloses preferred embodiments of the present invention.

BRIEF DESCRIPTION OF THE DRAWINGS

FIG. 1 is a perspective view of a preferred embodiment of the present invention.

FIG. 2 is a cross-sectional view of the preferred embodiment of FIG. 1, partially cut away, and taken along the 2—2 line thereof, also showing a needle of a syringe inserted thereinto.

DETAILED DESCRIPTION OF THE PREFERRED EMBODIMENT

Referring to FIGS. 1 and 2, there is shown a bone cement preparation device according to the preferred embodiments of the present invention, comprising flexible bag member 1 being substantially sealed so that a substantial vacuum is formed therein; and means, operably associated with the sealed bag member, for transferring substances into and out of the bag member, comprising port member 3 having membrane 4 secured thereover. As shown in FIG. 1 of the drawings, bag member 1 has an outer periphery, and a seal 5 which extends substantially continuously around the outer periphery thereof, in order to maintain the aforementioned substantial vacuum therein.

Bag member 1 preferably but not necessarily comprises a substantially sealed container made from flexible yet substantially tear-resistant and chemically-resistant material, such as polyethylene plastic film. Alternatively, bag member 1 is constructed from another material or plastic composition. Bag member 1 is suitably sized so that a sufficient amount of bone cement is prepared therein for use in a surgical procedure.

Bag member 1 is adapted for holding and mixing bone cement ingredients in a substantially airtight environment so that obnoxious fumes are prevented from escaping the container. In addition, bag member 1 providing a container for preparing bone cement in a substantially airtight vacuum allows the bone cement to mix and cure more quickly and substantially without defects or other imperfections, such as the cured cement having a heightened degree of porosity.

According to a preferred embodiment of the present invention, the powder polymer cement ingredient P is placed within bag member 1 prior to bag member 1 being sealed and/or formed so that the powder polymer is maintained in a substantial vacuum. Alternatively, the powder polymer is added to bag member 1 via port 3 prior to port 3 being substantially sealed over.

Port member 3 of the present invention is preferably but not necessarily disposed along an outer surface of bag member 1. As shown in FIGS. 1 and 2, port member 3 is suitably sized for insertion of a dispensing instrument therethrough so that an amount of liquid monomer can be added to bag member 1. Port member 3 is also sized so that the thoroughly mixed cement composition can be easily poured therefrom. As shown in FIG. 1, port member 3 is substantially circular from a front elevational view thereof. Alternatively, port member 3 is formed into other shapes. In a preferred embodiment of the present invention, port member 3 and bag member 1 are integrally formed as a unitary member.

Referring to FIG. 2, port member 3 extends outwardly from the outer surface of bag member 1 so that instruments, such as a syringe 6, may be inserted into port member 3 with less chance of additionally penetrating through the back surface of bag member 1. Further, port member 3 extending substantially outwardly from the outer surface of bag member 1 allows a user to firmly grasp the edge of port member 3 when inserting an instrument therethrough, thereby ensuring a clean and true penetration.

As stated above, bag member 1 is substantially sealed so that liquid monomer is added to the powder polymer in a substantial vacuum. Accordingly, port member 3 includes membrane 4 which extends over port member 3 so as to form a substantial seal therewith. In order to add liquid monomer to bag member 1, membrane 4 of port member 3 is preferably penetrated by an instrument which is capable of holding and discharging the liquid monomer.

According to the preferred embodiments of the present invention, membrane 4 of port member 3 is constructed from a resilient material so that any small perforations in membrane 4 are quickly sealed over. In this way, instruments having needles, such as that shown at 8, may temporarily penetrate membrane 4 for insertion of liquid monomer into bag member 3 without leaving permanent apertures which may interfere with or otherwise affect the mixing of the monomer with the powder polymer. In a preferred embodiment of the present invention, membrane 4 of port member 3 is constructed from a rubber composition. As seen in the illustration of FIG. 2, the membrane 4 is substantially uniform in thickness throughout the extent thereof.

Membrane 4 is preferably but not necessarily sealed over port member 3 following insertion of powder polymer P within bag member 1.

The method of preparing bone cement for surgical applications according to the preferred embodiments of the present invention comprises the step of initially obtaining bag member 1 having powder polymer P substantially sealed therewithin. At this initial stage, a vacuum is present in the bag member 1, and the membrane 4 has not been previously punctured. Next, liquid monomer is drawn into an instrument, such as a syringe 6, and thereafter the needle 8 of the instrument is inserted through port member 3, thereby penetrating membrane 4 thereof. The liquid monomer is then discharged from the instrument so that it is deposited in bag member 1. The perforation formed by the instrument is substantially sealed as the instrument is withdrawn from port member 3. Next, the bone cement is thoroughly manually mixed by manipulating bag member 1 by hand. Thereafter, the bone cement is dispensed from bag member 1 by cutting away a portion of membrane 4 and pouring the bone cement therefrom.

Although there have been described what are currently considered to be the preferred embodiments of the present invention, it will be understood that the invention can be embodied in other specific forms without departing from the spirit or essential characteristics thereof.

The described embodiments are, therefore, to be considered in all aspects as illustrative, and not restrictive. The scope of the invention is indicated by the appended claims rather than the foregoing description.

What is claimed is:

1. A container for mixing bone cement, comprising:

a flexible bag member, said flexible bag member having a substantial vacuum formed therein;

means, operably associated with said flexible bag member, for allowing transfer of a substantially liquid composition into said flexible bag member; and a powder polymer disposed within said flexible bag member for mixing with a liquid monomer to form a bone cement;

wherein said liquid transfer allowing means comprises a port member which is disposed along an outer surface of said flexible bag member.

2. A container as recited in claim 1, wherein said bag member includes a membrane which substantially covers said port member.

3. A container as recited in claim 2, wherein:

a thickness of said membrane of said port member is sized to allow a needle to pass therethrough.

4. A container as recited in claim 3, wherein:

said membrane is substantially rubber.

5. A container as recited in claim 2, wherein said membrane is substantially uniform in thickness throughout the extent thereof.

6. A container as recited in claim 1, wherein:

said port member extends substantially outwardly from a surface of said flexible bag member.

7. A container as recited in claim 6, wherein:

said bag member includes a membrane which is substantially disposed over said port member.

8. A container as recited in claim 7, wherein:

said membrane is substantially resilient so as to form a seal over a perforation made therein.

9. A container as recited in claim 8, wherein:

said membrane is constructed from a rubber composition.

10. A method of preparing bone cement for securing articles to bones, comprising the steps of;

obtaining a flexible container having a powder polymer therein, said flexible container being substantially vacuum sealed and having a substantial vacuum formed therein, said flexible container having a port member disposed along a surface thereof, said flexible container further comprising a membrane which extends across said port member, wherein said membrane has not been previously punctured;

obtaining an instrument for holding and dispensing a liquid composition;

placing a liquid monomer in said instrument;

injecting said liquid monomer from said instrument into said flexible container by inserting a portion of said instrument through said port member of said flexible container; and mixing said liquid monomer with said powder polymer within said flexible container.

11. A method as recited in claim 10, wherein:

said mixing step comprises mixing said liquid monomer and said powder polymer together by manipulating said flexible container by hand.

12. A method as recited in claim 10, wherein:

said injecting step comprises the steps of inserting a portion of said instrument through said membrane and dispensing said liquid monomer into said flexible container.

13. A method as recited in claim 12, wherein:

said mixing step comprises the steps of withdrawing said instrument from said membrane and thereafter manually manipulating said flexible container so as to combine said powder polymer and said liquid monomer.

14. A method as recited in claim 13, wherein:

said membrane of said port member is a rubber composition.

15. A method as recited in claim 10, further including the step of:

dispensing said mixture from said port member of said flexible container after said liquid monomer and said powder monomer have been mixed.

16. A method as recited in claim 15, wherein:

said dispensing step includes the steps of separating a portion of said membrane from said port member and thereafter pouring said mixture therefrom.

17. A device for mixing bone cement, comprising:

a flexible bag member having a port extending outwardly thereon, said bag member being substantially vacuum sealed and having a substantial vacuum formed therein;

a port member disposed along a surface of said flexible bag member; and a powder polymer disposed within said flexible bag member for mixing with a liquid monomer to form a bone cement;

wherein said port member comprises a membrane which extends across said port.

18. A device as recited in claim 17, wherein:

said port member extends substantially outwardly from said surface of said flexible bag member.

19. A device as recited in claim 17, wherein:

said membrane is substantially rubber.

20. A container as recited in claim 17, wherein said membrane is substantially uniform in thickness throughout the extent thereof.

* * * * *